United States Patent [19]

Hults

[11] 4,006,333

[45] Feb. 1, 1977

[54] HIGHER RATED DOUBLE-POLE TRIGGER SWITCH

[75] Inventor: Harold W. Hults, New Berlin, Wis.

[73] Assignee: Cutler-Hammer, Inc., Milwaukee, Wis.

[22] Filed: June 11, 1975

[21] Appl. No.: 586,059

[52] U.S. Cl. ..... 200/157; 200/77

[51] Int. Cl.[2] ..... H01H 9/06

[58] Field of Search ..... 200/157, 77, 153 L, 200/153 LA, 153 LB, 67 G

[56] References Cited

UNITED STATES PATENTS

| | | | |
|---|---|---|---|
| 3,081,385 | 3/1963 | Scott | 200/67 G |
| 3,249,725 | 5/1966 | Hutt et al. | 200/153 LA |
| 3,322,914 | 5/1967 | Puccini | 200/67 G |
| 3,869,590 | 3/1975 | Hultz | 200/157 |

*Primary Examiner*—James R. Scott
*Assistant Examiner*—Morris Ginsburg
*Attorney, Agent, or Firm*—Hugh R. Rather; William A. Autio; Michael E. Taken

[57] ABSTRACT

A multipurpose electric trigger switch adapted to be mounted in the handle of a portable electric tool for controlling the A.C. power circuit and, to afford a higher rating, the switch is provided with double-pole butt contacts. The contacts of the switch have a controllable amount of wipe, very low bounce, are non-teasible, have steady contact pressure at the point of tripping open, and have a considerable amount of trigger lever movement between trip "on" and trip "off" positions. The amount of wipe is controlled by the amount of flexure of flexible contract terminals. The low bounce and non-teasibility are controlled by the angular rocking of a spring-biased self-centering rockable plunger and the snapping action of an actuator having camming surfaces in engagement with the plunger and rocking surface in engagement with the flexible contact terminals. Steady contact pressure at the point of tripping open is achieved due to an inclined camming surface of the actuator rising to an apex point. The amount of trigger lever movement between trip "on" and trip "off" positions is controlled by the angular degree of rocking of the plunger and the lateral distance across inclined camming surfaces of the actuator.

12 Claims, 7 Drawing Figures

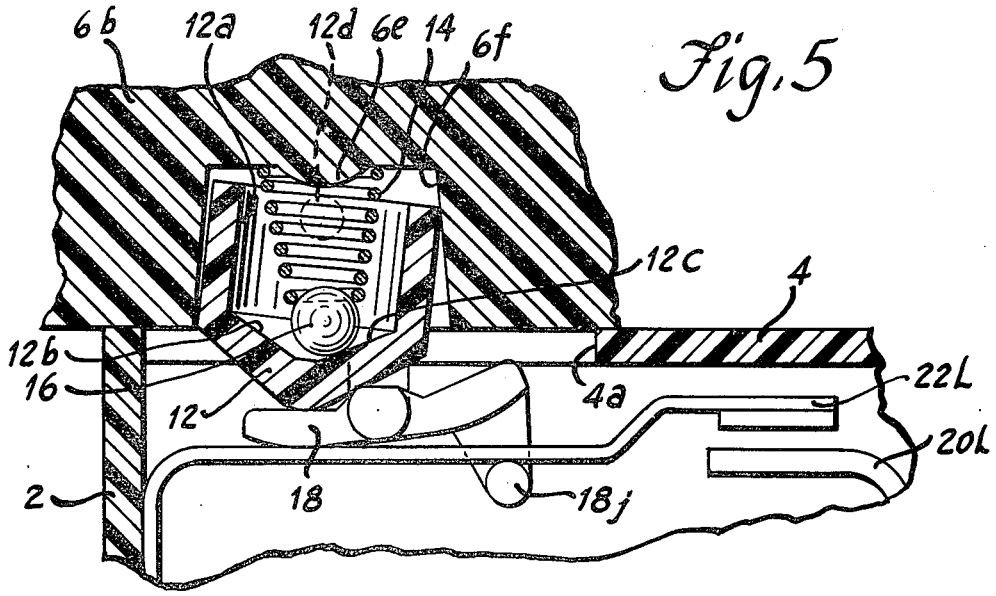
Fig. 5
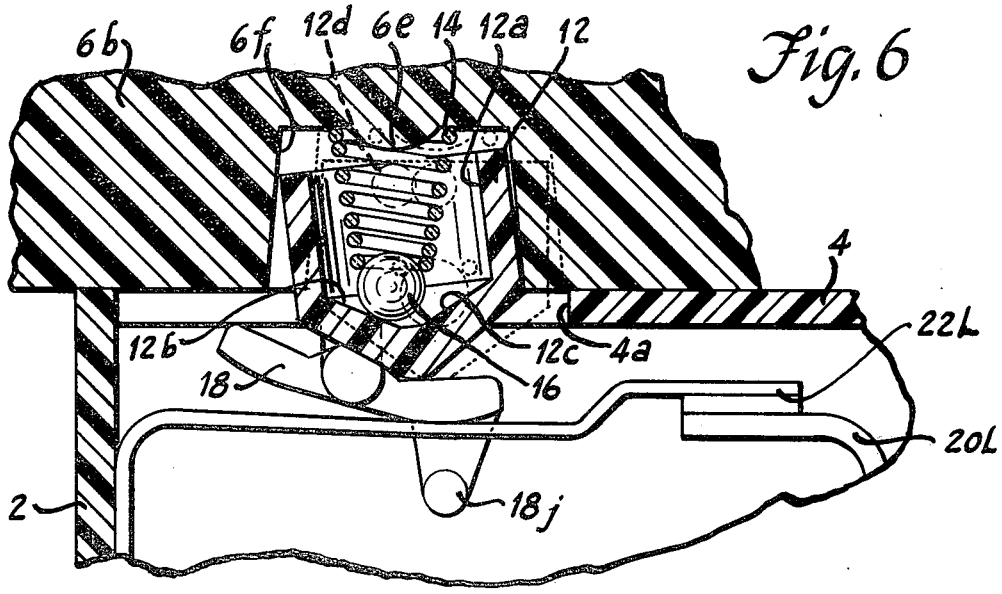
Fig. 6
Fig. 7
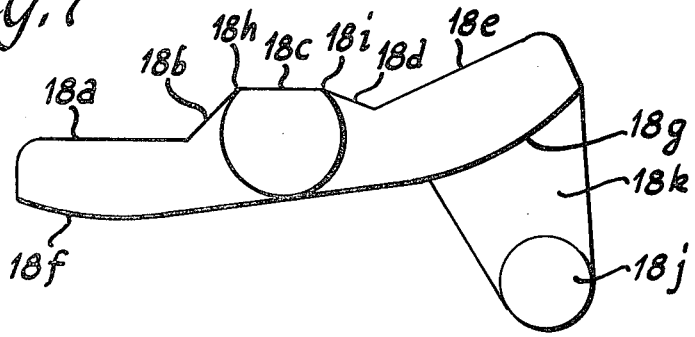

HIGHER RATED DOUBLE-POLE TRIGGER SWITCH

BACKGROUND OF THE INVENTION

Electric switches, including trigger switches for portable electric tools, have been known heretofore. However, these prior switches have been subject to one or more disadvantages that have limited their electrical capabilities such as sliding contacts subject to excessive wear that limits the life of the switch, contacts that are teasible and contact operating mechanisms that reduce contact pressures prior to opening thereby causing early deterioration, and short trigger movement between contact closed and open positions that causes frequent or false operation and might create dangerous conditions particularly when used in portable electric circular saws. While my prior U.S. Pat. No. 3,869,590, dated Mar. 4, 1975, discloses a switch structure that overcomes these disadvantages, this invention relates to an alternative structure for accomplishing the same.

SUMMARY OF THE INVENTION

This invention relates to electric switches, including double-pole higher rated tool handle switches of the trigger operated type.

An object of the invention is to provide an improved switch.

A more specific object of the invention is to provide an improved higher rated switch.

Another specific object of the invention is to provide an improved non-teasible butt contact switch.

Another specific object of the invention is to provide an improved switch of the aforementioned type having a controllable amount of wipe.

Another specific object of the invention is to provide an improved switch of the aforementioned type having low contact bounce.

Another specific object of the invention is to provide an improved switch of the aforementioned type having steady contact pressure at the point of trip open.

Another specific object of the invention is to provide an improved switch of the aforementioned type having substantial trigger movement between trip "on" and trip "off" positions to prevent repeated or accidental switch operation.

Another specific object of the invention is to provide an economical and reliable higher rating contact mechanism for an electric switch.

Other objects and advantages of the invention will hereinafter appear.

BRIEF DESCRIPTION OF THE DRAWINGS

FIG. 5 is a further enlarged fragmentary vertical cross-sectional view showing the switch of FIG. 1 during trigger depression;

FIG. 6 is a fragmentary vertical cross-sectional view showing the switch of FIG. 1 during trigger release; and FIG. 7 is a still further enlarged elevational view of the actuator of FIGS. 5 and 6.

DESCRIPTION OF THE PREFERRED EMBODIMENT

Referring to FIGS. 1–4, there is shown a double-pole higher rated tool handle switch constructed in accordance with the invention. By higher rated is meant that for an electrical rating of 12 amperes, 125 volts, having an inrush current of 60 amperes on make and a current of 12 amperes on break, for example, it will have an operational life rating of 50,000 to 60,000 operations, an increase of 4 to 5 times over prior lower rated switches in the same size of housing. Thus, it can be directly substituted for th lower rated switches without any modification of the nesting structure within the tool handle.

Figure 1:
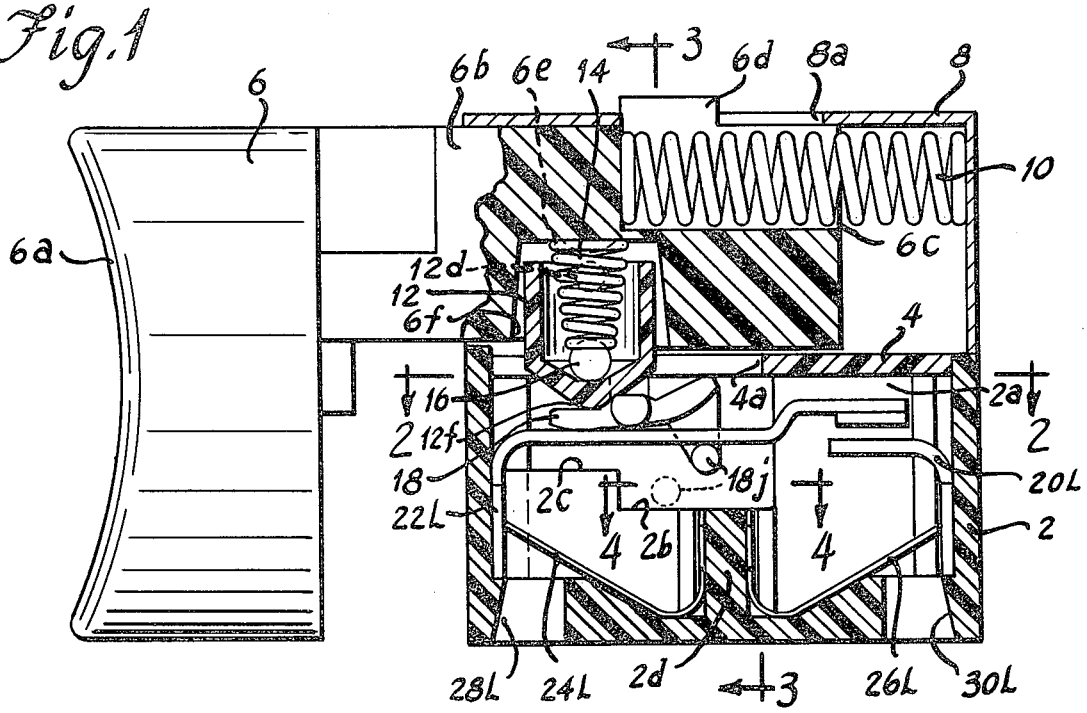
FIG. 1 is an enlarged partial, vertical cross-sectional view of th switch taken along line 1—1 of FIG. 3 to show one pole of the two pole electric switch.
Figure 2:
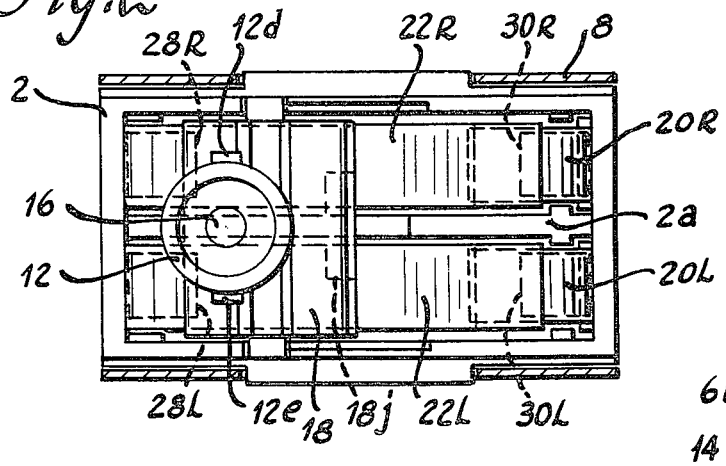
FIG. 2 is a horizontal cross-sectional view taken along line 2—2 of FIG. 1 to show a top view of the double-pole contacts.

As shown in FIGS. 1 and 2, this switch is provided with an insulating base 2 generally rectangular in shape and open at the top for housing the double-pole switch contacts, the left pole of which is shown in FIG. 1. The top of this base is closed by an insulating cover 4 having an aperture **4*a* therein providing clearance for movement of the plunger hereinafter described. The interior of this base is divided into two compartments, left and right, for the respective poles of the double-pole switch, by a longitudinal center dividing wall having a rear portion 2*a* that extends all the way up to cover 4, a lower center portion 2*b* leaving clearance for the lifter member of the actuator and providing a stop therefore as shown in broken line in FIG. 1, and an intermediate height forward portion 2*c* leaving clearance for the front part of the actuator. These left and right compartments are each divided into two subcompartments, front and back, for the movable and stationary contact connector clips, by a lateral wall 2*d*** extending across the middle thereof.

Figure 3:
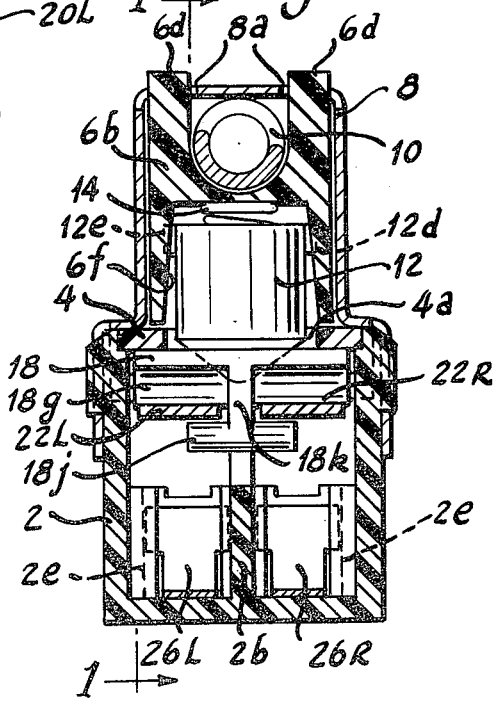
FIG. 3 is a vertical cross-sectional view taken along line 3—3 of FIG. 1 to show a rear view of the plunger and the actuator.

An insulating trigger 6 has a finger-engaging portion **6*a* extending forwardly from the base and a slidable portion 6*b* overlying the base and held thereon by a frame 8 that is secured to the base in a known manner. A trigger return spring provides the switch with a momentary action. For this purpose, a helical compression spring 10 is positioned in a groove 6*c* that extends forwardly partway from the rear end of slidable portion 6*b* of the trigger. The rear end of this spring bears against the rear wall of the frame and the front end thereof bears against the vertical wall at the front end of such groove. To limit trigger movement in both directions, the frame is provided with a pair of rectangular apertures 8*a* and the top of the slidable portion of the trigger is provided with a pair of projections 6*d* extending up through the respective apertures for limited movement therein as shown in FIGS. 1 and 3**.

A plunger 12 extends from the trigger down into the base through aperture **4*a* in the cover. For this purpose, a frusto-conical bore of 6*f* converges up from the bottom of the slidable portion of th trigger and is large enough to freely receive plunger 12. The plunger is provided with a downardly extending round bore 12a having a shallow conical bottom surface providing forward and rearward inclined surfaces 12*b* and 12*c* as shown in FIG. 5. A frusto-conical compression spring 14 is seated at its upper and widest end against the slidable portion of the trigger about an arcuate protrusion 6*e* formed thereon and extending downwardly, partially within said spring. This spring presses a sphere 16 into the shallow conical bottom. The downwardly decreasing diameter of spring 14 provides clearance for its lower end to move forwardly or rearwardly within the bore as the sphere rolls up either inclined surface as hereinafter described. Sphere 16 is held against the bottom surface of bore 12***a* by the bias of the compression spring, and hence the plunger is biased downwardly against camming surface 18*a* of a rockable two-position snap actuator 18 hereinafter described. Furthermore, the spring, due to the seating of its upper end, provides a centering bias on the plunger, tending to retain the plunger in its vertical position as shown in FIG. 1. As shown in FIGS. 1–3, the plunger is further provided with two opposite studs 12*d* and 12*e* which ride up and down in vertical slots in bore 6*f*.

Left and right stationary contacts 20L and 20R are retained in slots in the rear end of base 2. These stationary contacts extend from their anchored ends up, then forward the front.

Left and right flexible contact terminals 22L and 22R are retained in slots in the front end of base 2. The flexible contact terminals extend from their anchored ends up, then toward the rear, passing beneath and in contact with actuator 18, then at an upward angle, then toward the rear again to overlap stationary contacts 20L and 20R in spaced apart relation. These flexible contact terminals bias actuator 18 upwardly to balance the downward bias applied to the plunger by spring 14.

Figure 4:
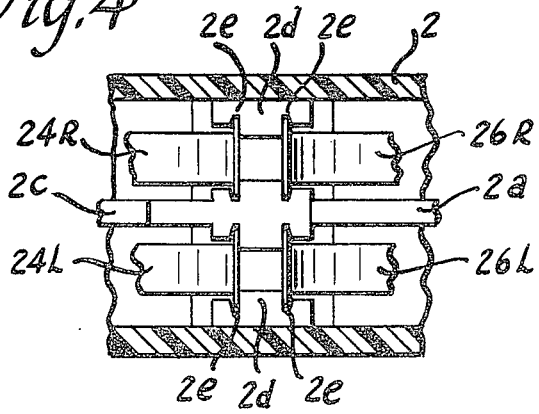
FIG. 4 is a partial, horizontal cross-sectional view taken along line 4—4 of FIG. 1 to show the wire retention clips.

In order to make electrical connections to the two stationary contacts and the two flexible contact terminals of the double-pole switch, there are provided a first pair of connector clamps 24L and 24R, at the forward bottom of the base, and a second pair of connector clamps 26L and 26R, at the rear bottom of the base as shown in FIGS. 1 and 4. These clamps are formed alike from a ribbon-like metal strip and each is provided with a pair of short wings at the vertical mounted end thereof adjacent the center dividing wall 2*b* of the base whereby they are retained in a pair of vertical grooves 2*e* in the base as shown in FIG. 4. From the lower end of such vertical retaining portion, each connector clamp is bent up about 30° from the horizontal so that the other end thereof rests against the flat inner surface of the retaining shank of the respective stationary contact or flexible contact terminal. The bottom of the base is provided with two pairs of holes 28L, 28R and 30L, 30R through which solid, or tinned stranded, electric wires may be pushed in between the shanks and the respective wire clamps to make connections thereto.

Rockable two-position snap actuator 18 has five upper camming surfaces 18*a*–18*e*, two lower rocking surfaces 18*f* and 18*g*, and two apex points 18*h* and 18*i* as shown in FIG. 7. The actuator is positioned so that one of its camming surfaces is always in engagement with the lower end 12*f* of the plunger and one of its rocking surfaces is always in engagement with the top of said flexible contact terminals 22L and 22R. As illustrated in FIGS. 3 and 7, the actuator is provided with a lifter member 18*j* having an integral connecting portion 18*k* extending from between the two halves of surface 18*g* down between flexible contact terminals 22L and 22R. This lifter member 18*j* has lifting projections extending left and right below flexible contact terminals 22L and 22R, but not necessarily in engagement therewith when the contacts are open, as shown in FIG. 1.

DESCRIPTION OF THE OPERATION OF THE PREFERRED EMBODIMENT

When the trigger 6 is depressed from the position shown in FIG. 1 to the position shown in FIG. 5, the lower end 12*f* of the plunger 12 slides along the horizontal camming surface 18*a* of the actuator. When the plunger reaches inclined camming surface 18*b*, further depression of the trigger causes the plunger to rock forwardly opposite the direction of trigger movement, or pivot clockwise on its studs 12*d* and 12*e* as seen in FIG. 5, due to the in-line clearance between the plunger and the frusto-conical bore 6*f* in the trigger. Sphere 16 simultaneously rides up rearward inclined inner surface 12*c* of the plunger due to the centering bias of frusto-conical compression spring 14, thereby compressing said spring along its vertical axis.

As illustrated in FIG. 5, after the plunger abuts the forward wall of the frusto-conical bore, further depression of the trigger causes the plunger to ride up inclined camming surface 18*b* of the actuator, further compressing spring 14. When the lower and 12*f* of the plunger reaches the apex point 18*h* of the actuator, the plunger will suddenly slide or snap across camming surface 18*c* and down incline 18*d* due to the downward and centering bias of spring 14 causing sphere 16 to ride back down surface 12*c* causing the plunger to rock back to its center position, thereby causing the actuator to suddenly rock clockwise to its alternative position, shown in FIG. 6, thereby snapping the contacts closed. In the contacts closed position, with the trigger fully depressed, the lower end 12*f* of the plunger is in engagement with now-horizontal camming surface 18*e* of the actuator, rocking surface 18*g* is in engagement with the topside of flexible contact terminals 22L and 22R, and lifter member 18*j* is stopped against wall 2*b* as shown in broken line in FIG. 1.

When the trigger is released, the above described snap action is reversed. Lower end 12*f* of the plunger slides along now-horizontal camming surface 18*e* of the actuator. When the plunger reaches inclined camming surface 18*d*, which incline under this condition is the same as that of surface 18*b* during trigger depression, the plunger will rock backwardly opposite the direction of trigger release, or pivot counterclockwise on its studs to abut the rear wall of the bore as seen in FIG. 6. Sphere 16 simultaneously rides up forward inclined inner surface 12*b* of the plunger, with the axis of spring 14 remaining vertical. When the plunger reaches apex point 18*i*, it will suddenly slide or snap across camming surface 18*c* and down incline 18*b* due to the downward and centering bias of spring 14 acting on the plunger through sphere 16, causing the plunger to suddenly rock to its center position thereby causing the actuator to suddenly rock counterclockwise to its original position thereby opening the contacts. The contacts open under the force of the upward bias of flexible contact terminals 22L and 22R. However, should be contacts stick or weld, the hammer blow provided by lifter member 18*j* upon the underside of flexible contact terminals 22L and 22R frees any welds that may have formed.

While there is shown a wall 2*b*, acting as a stop, in FIG. 1, an alternative embodiment would eliminate the need therefor and rely upon the structural strength of flexible contact terminals 22L and 22R and stationary contact terminals 20L and 20R to maintain the desired contact pressure in the contacts closed position.

The objects of the invention are achieved in the following manner.

The amount of wipe is controlled by the strength of spring 14 and the flexure in flexible contact terminals 22L and 22R upon snapping engagement by rocking surface 18*g* of the actuator.

There is minimum contact bounce because the downwardly biased plunger exerts a continual downward force as it rides on camming surfaces 18*c*, 18*d*, and 18*e*, after the contacts are closed.

The contacts are non-teasible because the rockable snap actuator and the rockable biased plunger make it impossible for the user to hold the lower end 12*f* of the plunger at the apex points 18*h* or 18*i* or on the adjacent transitory camming surface 18*c* of the actuator.

There is steady contact pressure at the point of tripping open because as the plunger climbs the incline to apex point 18*i*, the point of trip open, during trigger release, rocking surface 18*g* of the actuator applies a constant undiminished force to flexible contact terminals 22L and 22R, and the actuator remains in its alternate position until the contacts are tripped open.

There is substantial trigger movement between contact trip "on" and trip "off" positions, thus preventing frequent or false intermittent operation, because when the plunger reaches apex point 18*h*, point of trip "on", the plunger will slide across camming surfaces 18*c* and 18*d*. Release of the trigger does not instantaneously trip the switch off because the trigger must be released far enough to allow the plunger to rock back against the rear wall of the frusto-conical bore and far enough to allow the plunger to ride up inclined camming surface 18*d* to apex point 18*i*, point of trip "off". Furthermore, when the plunger reaches apex point 18*h* during trigger depression, there is a decrease in the force opposing trigger depression because spring 14 is no longer being compressed, and hence the net force depressing the trigger is increased, that is, there is a natural and momentarily uncontrollable tendency by the user to accelerate trigger depression upon a decrease in resistive force thereagainst. Furthermore, as the plunger slides down surface 18*d*, the expansion of spring 14 provides an additional force component in the direction of trigger depression.

I claim:

1. An electric switch comprising: an insulating housing;

stationary contact means mounted in said housing;

flexible contact means mounted in said housing for engaging said stationary contact means;

a resiliently biased switch operator mounted for movement in said housing;

a resiliently biased plunger rockable with respect to and arranged for movement by said switch operator; and rockable contact actuator means having camming surfaces arranged for engagement by said plunger and rocking surfaces arranged for engaging said flexible contact means.

2. An electric switch comprising:

an insulating housing;

stationary contact means mounted in said housing;

flexible contact means mounted in said housing for engaging said stationary contact means;

a resiliently biased switch operator mounted for movement in said housing;

a plunger extending from said switch operator which is depressible in a plane parallel to said movement and which is rockable about an axis perpendicular to said movement;

resilient means biasing and centering said plunger; and a rockable contact actuator having spaced inclined camming surfaces connected by an intermediate surface and arranged for engagement by said plunger and having a portion engaging one side of said flexible contact means so that when said switch operator is moved and said plunger climbs up one of said inclined camming surfaces of said rockable actuator, thereby causing said plunger to rock against the force of said biasing and centering means, said plunger will reach the apex of the inclined camming surface and suddenly snap across said intermediate surface of said actuator, due to the force of said biasing and centering means, thereby causing said actuator to suddenly rock about its axis to an alternate position closing said contact means.

3. An electric switch comprising:

an insulating housing;

stationary contact means mounted in said housing;

flexible contact means mounted in said housing for engaging said stationary contact means;

a switch operator mounted for rearward-forward sliding movement in said housing and having a recess;

a rockable contact actuator pivotally supported in said housing over said flexible contact means;

a plunger extending down from said switch operator recess;

means supporting said plunger in said switch operator recess for limited forward-rearward rockable movement;

resilient centering means biasing said plunger down against said rockable contact actuator and into its center position;

and said rockable contact actuator comprising a pair of inclined camming surfaces, one of which is effective upon rearward actuation of said switch operator to cause forward rocking of said plunger off center against the force of its resilient centering means whereafter said plunger slides up said one inclined camming surface to its apex allowing said resilient centering means to initiate snap-action movement of said plunger across said rockable contact actuator and down its other inclined camming surface for snap-action rocking thereof and pressing said flexible contact means into closing engagement with said stationary contact means, and said other inclined camming surface being effective upon forward return movement of said switch operator to cause rearward rocking of said plunger off center against the force of said resilient centering means whereafter said plunger slides up said other inclined camming surface to its apex allowing said resilient centering means to initiate snap-action movement of said plunger back across said rockable contact actuator and down said one inclined camming surface for snap-action rocking thereof and release of said flexible contact means to afford reopening of said contact means under the inherent bias thereof.

4. An electric switch according to claim 3 wherein said switch operator reces is a frusto-conical bore diverging downwardly to allow rocking of said plunger therein.

5. An electric switch according to claim 3 wherein said plunger has a bore extending down thereinto having a shallow conical bottom and siad resilient centering means comprises a frusto-conical spring converging downwardly from said switch operator into the bore of said plunger and a sphere held against said shallow conical bottom by said spring.

6. An electric switch according to claim 3 wherein said rockable contact actuator is pivotable about a fulcrum point to contacts closed or contacts open positions and further comprises:

a first rocking surface for engaging the top side of said flexible contact means in contacts open position and a second rocking surface for engaging the top side of said flexible contact means in contacts closed position; and a plurality of camming surfaces variously engages by said plunger comprising a central surface bridging said fulcrum point and forming apexes at each end thereof which act as points of trip open and trip close of said contact means, declined surfaces diverging from said apexes with the slope of one in the contacts open position equivalent to the slope of the other in the contact closed position, and surfaces extending from the diverge ends of said declined surfaces.

7. An electric switch according to claim 6 wherein said rockable contact actuator further comprises a lifter member for engaging the underside of said flexible contact means to break any contact welds.

8. A higher rated double-pole trigger switch comprising:

an insulating housing having two compartments;

stationary contacts in the respective compartments;

flexible contacts in the respective compartments having portions overlapping in the respective stationary contacts to provide a gap and to provide a double a double-pole switch;

a spring-biased trigger mounted for limited sliding movement in said housing and having a lower bore;

a contact actuator rockably supported in said housing over said flexible contacts and operative when rocked in one direction to close said flexible contacts with said stationary contacts and operative when rocked in the other direction to release said flexible contacts to return to open position;

a plunger extending down from said bore;

resilient self-centering means biasing said plunger down against said contact actuator and to its center position;

and said contact actuator having a pair of opposed inclines joined by a flat surface, one of said inclines being operable upon depression of said trigger to cause forward rocking of said plunger against the force of its self-centering means whereafter said plunger rides up and over said one incline to allow said self-centering means to accelerate said plunger along said flat surface and down the other incline to effect snap-action rocking of said contact actuator in said one direction to close the contacts, and said other incline being operable upon release and return of said trigger to cause rearward rocking of said plunger against the force of said self-centering means whereafter said plunger rides up and over said other incline to allow said self-centering means to accelerate said plunger back along said flat surface and down said one incline to effect snap-action rocking of said contact actuator in said other direction to effect reopening of the contacts.

9. A higher rated double-pole trigger switch according to claim 8 wherein the lower bore of said trigger is a frusto-conical bore diverging downwardly from a portion of said trigger.

10. A higher rated double-pole trigger switch according to claim 8 wherein said plunger comprises a bore extending down thereinto having a shallow conical bottom and said resilient self-centering means comprises a frusto-conical spring converging downwardly from said trigger into the bore of said plunger and a sphere held by said spring against said shallow conical bottom.

11. An electric switch according to claim 8 wherein said rockable contact actuator is pivotable about a fulcrum point to contacts closed or contacts open positions and further comprises:

a first rocking surface for engaging the top side of said flexible contact means remote from said gap in contacts open position and a second rocking surface for engaging the topside of said flexible contact means close to said gap in contacts closed position; and a plurality of camming surfaces variously engaged by said plunger comprising a central surface bridging said fulcrum and forming apexes at each end thereof which act as points of trip open and trip close of said contact means, declined surfaces diverging from said apexes with the slope of one in the contacts open position equivalent to the slope of the other in the contacts closed position, and surfaces extending from the bases of said declined surfaces.

12. A higher rated double-pole trigger switch according to claim 11 wherein said contact actuator further comprises a lifter member for engaging the underside of said flexible contact means to break any contact welds.

* * * * *